United States Patent [19]

Evertz

[11] Patent Number: 4,669,529

[45] Date of Patent: Jun. 2, 1987

[54] CONTINUOUS CASTING MOULD

[76] Inventor: Egon Evertz, Vorlander Str. 23, 5650 Solingen, Fed. Rep. of Germany

[21] Appl. No.: 858,869

[22] Filed: May 1, 1986

Related U.S. Application Data

[63] Continuation of Ser. No. 677,733, Dec. 3, 1984, abandoned.

[51] Int. Cl.[4] ..... B22D 11/00; B22D 11/124

[52] U.S. Cl. ..... 164/443; 164/108; 164/348; 164/418

[58] Field of Search ..... 164/98–105, 164/443, 485, 138, 459, 418, 348, 106–108, 111, 112

[56] References Cited

U.S. PATENT DOCUMENTS

| | | | |
|---|---|---|---|
| 34472 | 2/1962 | Babbitt | 164/348 |
| 3,853,309 | 12/1974 | Widmer | 164/98 X |
| 4,197,902 | 4/1980 | Von Jan et al. | 164/138 X |
| 4,276,994 | 7/1981 | Spalding | 164/98 X |

FOREIGN PATENT DOCUMENTS

| | | | |
|---|---|---|---|
| 57-50251 | 3/1982 | Japan | 164/418 |
| 58-132363 | 8/1983 | Japan | 164/98 |
| 2086435 | 5/1982 | United Kingdom | 164/138 |

*Primary Examiner*—Kuang Y. Lin
*Attorney, Agent, or Firm*—Holman & Stern

[57] ABSTRACT

A continuous casting chill mold, for the continuous casting of metals, particularly of steel, comprises a water-cooled interior section and an outer jacket section which avoids the problems associated with the machining of the cooling channels and at the same time reduces wastage, in that the interior section is produced by chipless (i.e. non-machining) production methods as a thin-walled sleeve having a dense microstructure, the interior section is surrounded by a coiled cooling pipe which, together with the interior section, is positively materially bonded to the outer jacket section consisting of copper applied by casting techniques. Neither in the cooling zone nor in the wall region of the mold cavity is there any risk of cutting into pores or pipes because all chip-removing machining is dispensed with.

21 Claims, 1 Drawing Figure

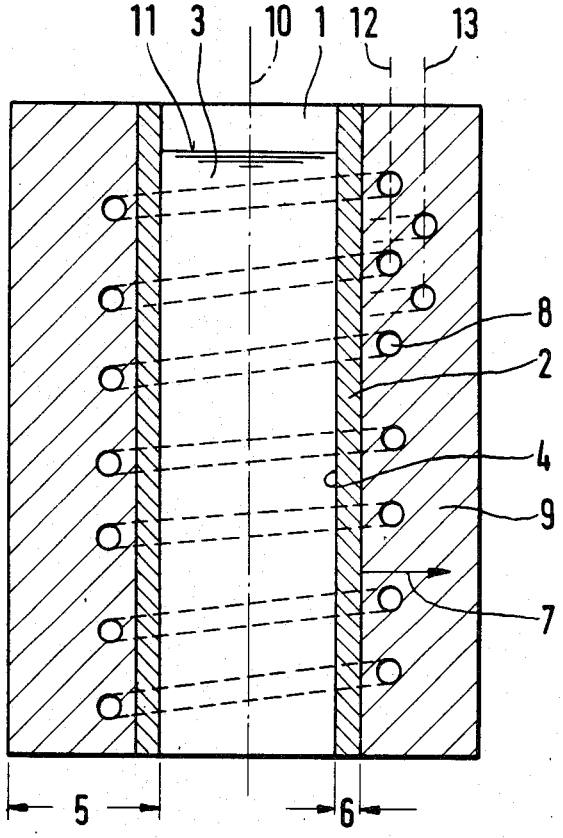
11
3
10
1
12
13
8
2
4
9
7
5
6

CONTINUOUS CASTING MOULD

This is a continuation of application Ser. No. 677,733, filed Dec. 3, 1984, now abandoned.

BACKGROUND OF THE INVENTION

Field of the Invention

The invention relates to a continuous casting mold of the kind comprising an interior section and an outer jacket section.

A continuous casting mold of this kind is known from German No. AS 19 64 048. In this mold the interior section is defined by plates which enclose a hollow mold space and which are provided on the outside with grooves formed by milling. The external walls of these interior sections are covered by a jacket section which in this case is formed by supporting plates which close up the said grooves. Cooling water is passed through these grooves so that sufficient heat can be extracted from the melt in the continuous casting process, particularly when steel is being cast. Correspondingly the molten metal will solidify and emerge from the lower part of the mold with an adequately firm and supportive outer shell. In addition to this type of split, or divided continuous casting mold (which is particularly well suited for the continuous casting of slabs), there are also undivided continuous casting molds with smaller casting cross sections for casting billets and blooms. Such undivided continuous casting molds also receive external machining to form grooves to which the coolant, which is generally water, can be applied. It is also possible to drill cooling channels into the mold walls. However this is relatively difficult because of the need to maintain a precise drilling position in view of the subsequent connections. Milled groove passages and drilled bores have this in common that the workpiece, generally a copper casting, must be subjected to chip removing machining processes. In such work the possibility cannot be excluded that unintentional material separation zones may be broached into which the coolant would then be able to enter. Such uncontrolled spread of cooling water inside the mold wall will, as a rule, render the latter useless. A further chip removing treatment is applied to the inside walls of the molds in order to make them sufficiently smooth and dimensionally accurate for the pass of the casting. Here again one cannot rule out the risk of cutting into pores created by the original casting process or other cavities in the walls. In such a case the mold is also quite useless. Added to this it must be remembered that the service life of the mold is limited by erosions which start from the inside wall. It is true that the latter may be compensated to a limited extent by further chip removing machining but this means, at any rate, that the mold in question is taken out of production for a corresponding length of time which, in turn, requires expensive stock holdings. Mechanical reconditioning of the molds is severely limited on the one hand by the dimensional specification of the continuous casting which must be observed and, on the other hand, by the required minimum wall thicknesses of the molds. This means that wall thickness in particular is considerably restricted due to the provision of such cooling channels or bores. With insufficient outer support such thin-walled molds may tear all the more easily as their mechanical strength at right angles to the radial grain orientation which is preferred due to the casting of the molds generally coincides with the direction of heat flow.

BRIEF SUMMARY OF THE INVENTION

The invention basically provides continuous casting molds of the kind specified in the sense that they can be produced at substantially less expense and without the risk of cutting into pores or other defect areas. Moreover, heat dissipation is improved by comparison with known cooling channels and even with reduced mold wall thickness tearing of the latter due to the reduced mechanical strength is avoided.

In accordance with the invention there is provided a continuous casting chill mold having liquid cooling means and comprising an interior section and an outer jacket section, characterized in that the interior section which has an internal wall which is designed in use to come into contact with molten metal to be cast is produced by production methods which do not involve machining in a thickness which is a small fraction of the total wall thickness and which has a microstructure which is more dense than that achieved normally by conventional die casting, and in that there is provided a cooling pipe which extends across the direction of heat flow from the interior section and which is disposed in the jacket section adjacent to the inner section, said jacket section being bonded to the interior section and to the cooling pipe.

In contrast with known chill molds which were produced completely by die casting followed by mechanical treatment or machining, the new continuous casting mold has a differentiated structure. While the interior section is so thin that no extensive crystals can be formed in the radial direction, the cooling channels are formed by cooling pipes which are characterized in that they have a cold deformation structure and can therefore take up particularly high tensile stresses in their longitudinal direction. These cooling pipes in their turn are anchored and materially bonded in the final conventionally cast jacket section which enters into a positive material bond also with the interior section. Since this dispenses with all chip removing machining in the interior of the mold and since the production of the interior section as well as that of the cooling pipes will not give rise to any pore-cavities or the like, it is now possible not only to produce the molds at a correspondingly reduced rate of scrap wastage but also to achieve at the same time a longer service life for the molds. The jacket section which is produced by casting methods, in contrast with the supporting or backing plates formerly used for the same function, is responsible for a considerably smaller share in the stability of the mold because the cooling pipes themselves produce a strong supporting effect.

The melting down of the cooling pipe during casting of the jacket can be safely prevented by applying a coolant to the cooling pipe during casting, for which purpose air may be used, when heat extraction by water is too high. Thus it is possible to use conventional dimensions of $\frac{1}{2}$ to 2 inch diameter and about 0.8 mm wall thickness for the cooling pipe. During the casting of the jacket section at a temperature which is approximately 30° C. above melting point the cooling pipe will stay intact while on the other hand the positive material bond is achieved.

The supporting action provided by the cooling pipe is particularly effective if the cooling pipe is coiled around the interior section of the mold like a bandage because this produces the most reliable anchoring of the cooling pipe. For this reason it is also possible to select lower total-wall thicknesses for the mold, especially since the cooling pipe may also be coiled in several planes or layers around the interior mold section. Naturally this is confined to one-part-continuous-casting-chill-molds as used for the continuous casting of billets or blooms.

The interior section need not necessarily consist of copper. With advantage, particularly when it is thin-walled, it may also be produced in nickel, whereby substantial improvements in wear properties can be obtained. The jacket section on the other hand is preferably cast from copper while the copper cooling pipe is produced by drawing. The drawing method may also be applied to the production of the interior section which thereby also receives a close fine structure without allowing any marked grain orientation in the heat flow direction of the mold. Another interesting production method for the interior section resides in galvanoplastic precipitation. Lastly, the interior section may be produced by application of a special casting process in which the core is adapted to act as a chill body relative to the casting. In this way a definite fine microstructure is obtained directly next to the core, or to a chill plate, which is quite exempt, particularly on the inside, from all pores, pipes or the like.

BRIEF DESCRIPTION OF THE DRAWING

The invention will now be more particularly described with reference to the accompanying drawing wherein: the single FIGURE is a sectional view of one example of a continuous casting chill mold in accordance with the invention.

DETAILED DESCRIPTION

The drawing shows a cross sectional view of a bloom mold which was chosen as an example of the invention. The mold has a cavity 1 which receives the molten metal 3 up to the level 11 and the metal 3 will in use emerge at the lower end with a frozen shell. The mold including its longitudinal axis 10 are here represented for straight through-flow. In practice this is often arcuate, but the invention is equally applicable to such a situation.

The interior section 2 has a very small wall thickness only and is produced by a non-machining process such as electrolytic nickel deposition, or galvanoplastic precipitation. Said interior section has a close or dense microstructure which, notably, shows no definite orientation in the direction of heat flow indicated by arrow 7. On the inside of the section there is a very smooth internal wall surface 4 along which the continuous casting may travel downwards without major wear of the inner section 2. The thickness 6 of the interior section 2 amounts to merely a fraction of overall wall thickness 5 of the mold.

The interior section 2 is surrounded by a coiled cooling pipe 8 disposed in an outer mold jacket 9, pipe 8 having two connections, not shown, for admission and discharge of cooling water. The windings of the cooling coil 8 have a longitudinal axis which coincides with the longitudinal axis 10 of the mold. In the right hand part of the drawing it has been indicated that the coils of the cooling pipe may be provided not only in just one layer 12 but also in a second layer 13 which second layer is lined up with the gap spaces between the windings of the first layer 12. This creates a very large surface area for heat dissipation. This heat dissipation is assured by virtue of positive material bonding between the mold jacket 9 and the interior section 2 as well as between said jacket 9 and the cooling pipe, particularly if copper is used for the jacket 9. Copper may also be used for the cooling pipe which may then be formed by drawing. Conveniently, the jacket section 9 is cast around the cooling pipe and around the interior section 2 so that the jacket will be intimately bonded to the interior section and to the cooling pipe.

The interior section, instead of being produced by an electrolytic deposition, or galvanoplastic precipitation may be produced by a drawing process or by a casting process, using a cavity-defining core which acts as a chill body which in turn promotes a fine and dense microstructure of the internal surface of said interior section.

I claim:

1. In a continuous casting chill mold having a wall comprised of an interior section and an outer jacket section, and a liquid cooling means, the improvement comprising:

an internal wall comprised of a galvanoplastic precipitated constituent metal substantially of nickel, which during use of the mold contacts molten metal to be cast, having a thickness which is a small fraction of the total wall thickness and a dense microstructure produced in a manner which does not include machining;

said mold having a longtitudinal axis;

a coiled cooling pipe coiled around in adjacent relation to said internal wall and extending in a direction transverse to the direction of heat flow from said internal wall during use of the mold with the axis of the coil coinciding with said longitudinal axis of the mold; and an outer jacket section is cast around and bonded to said internal wall and surrounding and bonded to said coiled cooling pipe.

2. A mold as claimed in claim 1 wherein, said outer jacket section comprises a copper casting.

3. A mold as claimed in claim 1 wherein, said cooling pipe comprises a drawn copper coil.

4. A mold as claimed in claim 2 wherein, said cooling pipe comprises a drawn copper coil.

5. A mold as claimed in claim 1 wherein, said coiled cooling pipe comprises a two-layer coil configuration of radially inner and outer layers.

6. A mold as claimed in claim 4 wherein, said coiled cooling pipe comprises a two-layer coil configuration of radially inner and outer layers.

7. A mold as claimed in claim 5 wherein the adjacent coil windings of said outer layer are disposed between adjacent coil windings of said inner layer in the longitudinal direction of the mold.

8. In a continuous casting chill mold having a wall comprised of an interior section and an outer jacket section, and a liquid cooling means, the improvement comprising:

an internal wall comprised of drawn constituent metal substantially of nickel, which during use of the mold contacts molten metal to be cast, having a thickness which is a small fraction of the total wall thickness and a dense microstructure produced in a manner which does not include machining;

said mold having a longitudinal axis;

a cooling pipe coiled around in adjacent relation to said internal wall and extending in a direction transverse to the direction of heat flow from said internal wall during use of the mold with the axis of the coil coinciding with said longitudinal axis of the metal; and an outer jacket section is cast around and bonded to said internal wall and surrounding and bonded to said coiled cooling pipe.

9. A mold as claimed in claim 8 wherein, said outer jacket section comprises a copper casting.

10. A mold as claimed in claim 8 wherein, said cooling pipe comprises a drawn copper coil.

11. A mold as claimed in claim 9 wherein, said cooling pipe comprises a drawn copper coil.

12. A mold as claimed in claim 8 wherein, said coiled cooling pipe comprises a two-layer coil configuration of radially inner and outer layers.

13. A mold as claimed in claim 11 wherein, said coiled cooling pipe comprises a two-layer coil configuration of radially inner and outer layers.

14. A mold as claimed in claim 12 wherein the adjacent coil windings of said outer layer are disposed between adjacent coil windings of said inner layer in the longitudinal direction of the mold.

15. In a continuous casting chill mold having a wall comprised of an interior section and an outer jacket section, and a liquid cooling means, the improvement comprising:

an internal wall comprised of a casting substantially of nickel produced with the use of a cavity-defining chill body core, which during use of the mold contacts molten metal to be cast, having a thickness which is a small fraction of the total wall thickness and a dense microstructure produced in a manner which does not include machining;

said mold having a longitudinal axis;

a coiled cooling pipe coiled around in adjacent relation to said internal wall and extending in a direction transverse to the direction of heat flow from said internal wall during use of the mold with the axis of the coil coinciding with said longitudinal axis of the mold; and an outer jacket section is cast around and bonded to said internal wall and surrounding and bonded to said coiled cooling pipe.

16. A mold as claimed in claim 15 wherein, said outer jacket section comprises a copper casting.

17. A mold as claimed in claim 15 wherein, said cooling pipe comprises a drawn copper coil.

18. A mold as claimed in claim 16 wherein, said cooling pipe comprises a drawn copper coil.

19. A mold as claimed in claim 15 wherein, said coiled cooling pipe comprises a two-layer coil configuration of radially inner and outer layers.

20. A mold as claimed in claim 18 wherein, said coiled cooling pipe comprises a two-layer coil configuration of radially inner and outer layers.

21. A mold as claimed in claim 19 wherein the adjacent coil windings of said outer layer are disposed between adjacent coil windings of said inner layer in the longitudinal direction of the mold.

* * * * *